US005176274A

United States Patent [19]

Jenkins

[11] Patent Number: 5,176,274

[45] Date of Patent: Jan. 5, 1993

[54] LEG SUPPORTED TRAY

[76] Inventor: James H. Jenkins, 6010 N. 26th St., Arlington, Va. 22207

[21] Appl. No.: 806,205

[22] Filed: Dec. 13, 1991

[51] Int. Cl.[5] ..... A47B 23/00

[52] U.S. Cl. ..... 220/17.1; 108/43; 206/557

[58] Field of Search ..... 206/557; 220/17.1; 224/267, 270; 108/6-8, 43

[56] References Cited

U.S. PATENT DOCUMENTS

| | | | |
|---|---|---|---|
| 527,108 | 10/1894 | Cooper | 108/43 |
| 2,039,922 | 5/1936 | Neats et al. | 108/43 |
| 2,663,603 | 12/1953 | Newman | 108/43 |
| 2,770,514 | 11/1956 | Idso | 108/43 |
| 2,844,429 | 7/1958 | Frey | 108/43 |
| 3,215,453 | 11/1965 | Malcom, Jr. | 108/43 |
| 4,976,204 | 12/1990 | Konkle | 108/43 |

FOREIGN PATENT DOCUMENTS

| | | | |
|---|---|---|---|
| 0030093 | 1/1911 | Sweden | 220/17.1 |
| 0919715 | 2/1963 | United Kingdom | 108/43 |

*Primary Examiner*—Jimmy G. Foster

[57] ABSTRACT

A leg supported tray and more specifically, a combination serving tray, book holder and game board that is supported from the legs of the person using the tray with the tray including an upstanding peripheral edge to retain articles on the tray and a pair of downwardly opening, generally semicircular leg engaging support members connected to the tray by a pivotal connection which can be locked in adjustable angular position. In a modified form of the invention, the leg engaging support members are each provided with a leg encircling strap that is adjustable in length by utilizing hook and loop pile fastening devices available under the trademark "VELCRO".

7 Claims, 2 Drawing Sheets

Fig. 6
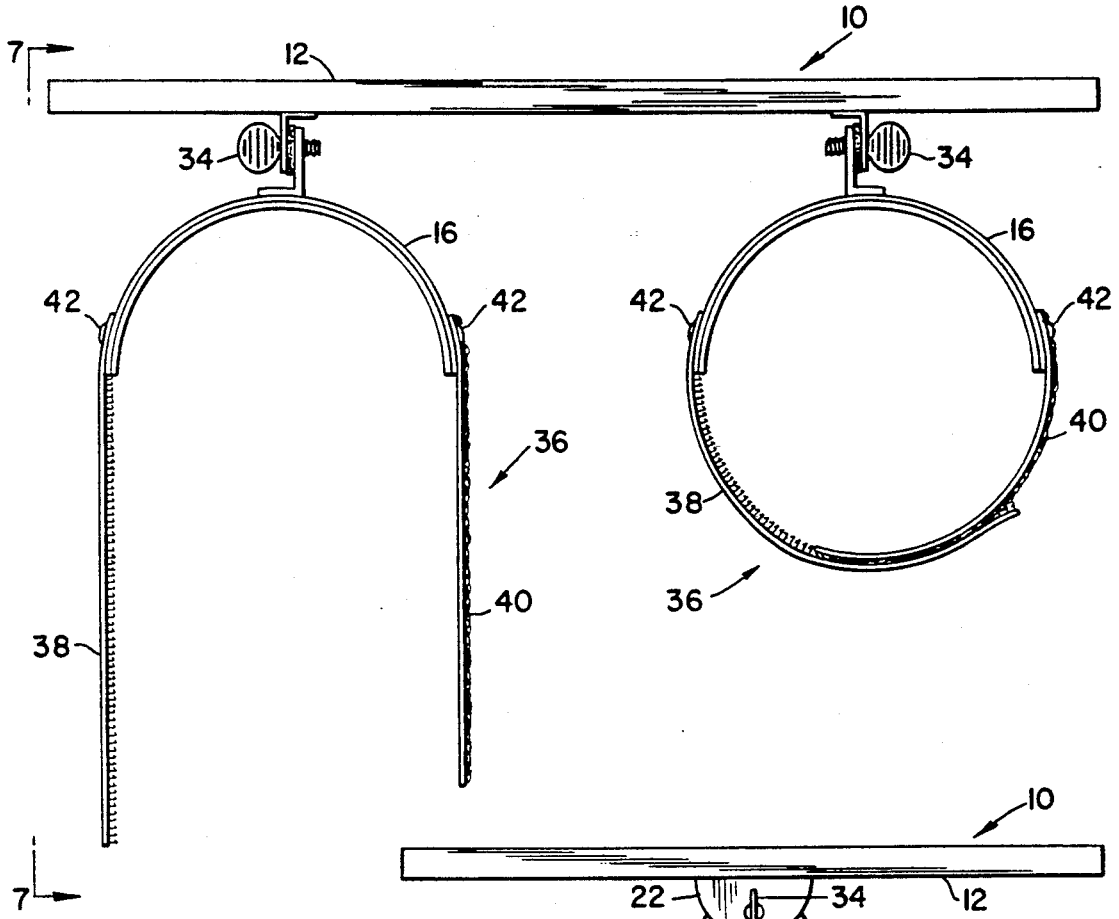
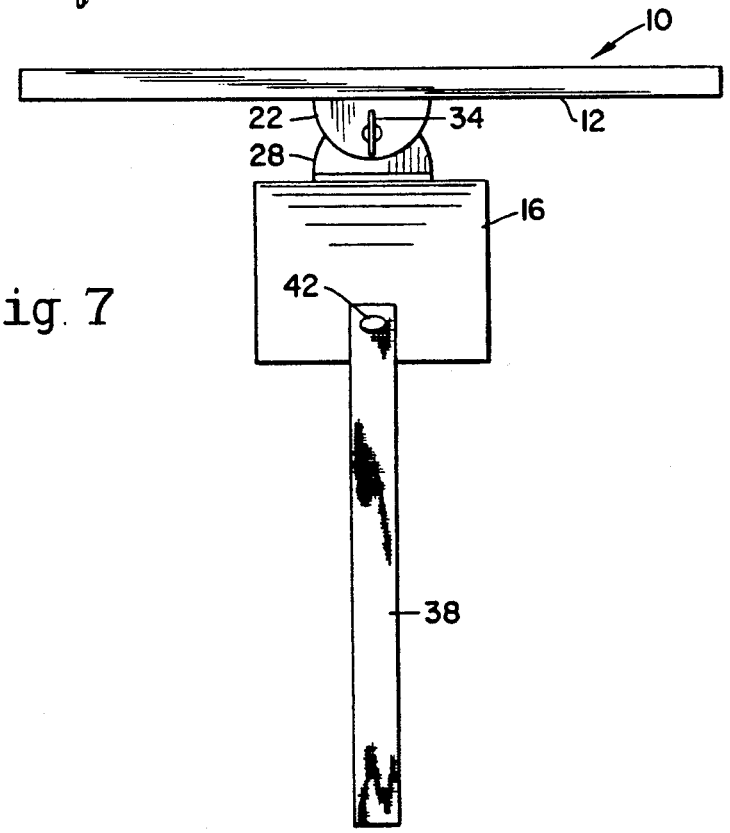
Fig. 7

LEG SUPPORTED TRAY

BACKGROUND OF THE INVENTION

1. Field of the Invention

The present invention generally relates to a leg supported tray and more specifically, a combination serving tray, book holder and game board that is supported from the legs of the person using the tray with the tray including an upstanding peripheral edge to retain articles on the tray and a pair of downwardly opening, generally semicircular leg engaging support members connected to the tray by a pivotal connection which can be locked in adjustable angular position. In a modified form of the invention, the leg engaging support members are each provided with a leg encircling strap that is adjustable in length by utilizing hook and loop pile fastening devices available under the trademark "VELCRO".

2. Description of the Prior Art

Trays for use by individuals in a chair or in bed are well known in order to hold food items, books and the like in a convenient and accessible position. Bed trays frequently are supported from a mobile stand positioned alongside of the bed with the tray extending over the bed. However, bed trays usually cannot be adjusted to a position that is comfortable for the bed occupant to use. Also known are trays having a "bean bag" bottom which are supported on the legs or in the lap of a bed or chair occupant. Such devices include a rigid tray structure with a flexible bag attached to the lower surface thereof with the bag being filled with beans, sand or other granular material which will generally conform to the shape of the surface which it engages. This type of tray does not provide a stable support capable of resisting downward pressure exerted at the edge portions of the tray since there is a tendency of the tray to pivot or swing as the granular material moves in the bag.

The prior art in this field of endeavor does not include a tray of the type which engages and is supported from both legs of the person using the tray with downwardly opening leg engaging support members of generally semicircular configuration combined with an angularly adjusted pivotal connection between the tray and the support members. Further, the prior art does not disclose a structure of this type utilizing leg encircling straps to secure the leg engaging support members to the legs of the user.

SUMMARY OF THE INVENTION

An object of the present invention is to provide a leg supported tray including a rigid panel with a peripheral flange having a pair of depending mounting flanges thereon combined with leg engaging support members of downwardly facing semicircular configuration provided with a central mounting flange on the upper surface with a thumb screw securing the tray in angular relation to the leg engaging support members with a friction washer between the flanges to secure the flanges in adjusted position when the thumb screw is tightened.

Another object of the invention is to provide a tray in accordance with the preceding object in which the leg engaging support members are provided with a liner on the lower surface thereof to cushion the engagement with the legs of the user with the support members and tray being constructed of sheet material having folded corners which will stiffen and rigidify the sheet material thus enabling the components to be constructed of readily available sheet metal or the like.

A further object of the invention is to provide a leg supported tray in accordance with the preceding objects in which the leg engaging support members are each provided with an adjustable strap for encircling the leg of the person using the tray.

Still another object of the invention is to provide a leg supported tray which is stable when in use, relatively inexpensive, capable of various uses in supporting various items in accessible position to the person using the tray with the tray structure being such that articles or items on the tray will be in a comfortable position for use by the person using the tray.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 6 is front elevation of a modified form of the invention in which the leg engaging support members have an adjustable strap for encircling the leg.

FIG. 7 is a side elevational view of the construction of FIG. 6.

DETAILED DESCRIPTION OF THE PREFERRED EMBODIMENTS

Figure 1:
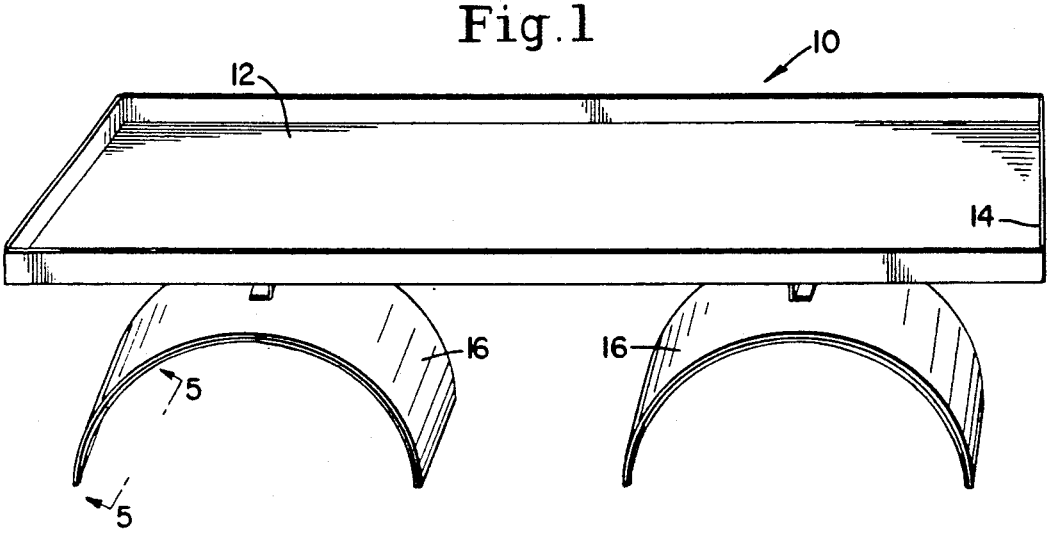
FIG. 1 is a front perspective view of the leg supported tray of the present invention.
Figure 2:
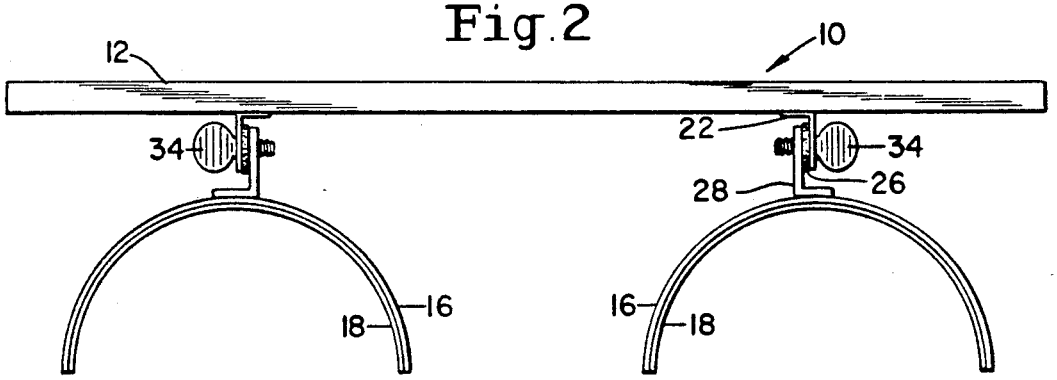
FIG. 2 is a front elevational view thereof.

Referring now specifically to the drawings, the leg supported combination tray of the present invention is generally designated by reference numeral 10 and includes a generally rectangular tray 12 having an upwardly extending peripheral wall 14 which is formed by folding the edges of a sheet metal member to provide a smooth edge and to provide stiffness and strength to the periphery of the tray.

Figure 5:
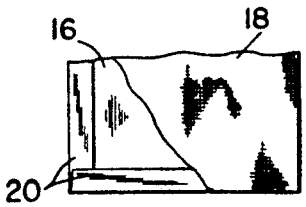
FIG. 5 is a fragmental view along reference line 5—5 on FIG. 1 with the interior covering of the leg engaging support member broken away to illustrate the folded corner construction of the support member.

The tray 12 is supported by a pair of leg engaging support members 16 each of which are generally semicircular in configuration and open downwardly with the lower surface thereof being provided with a coating or covering 18 in the form of a fabric or rubber coating to form a cushion for engaging the surface of the leg of the user. As illustrated in FIG. 5, the corners of the leg engaging support member are folded at 20 to provide for stiffness and strength of the support member 16.

Figure 4:
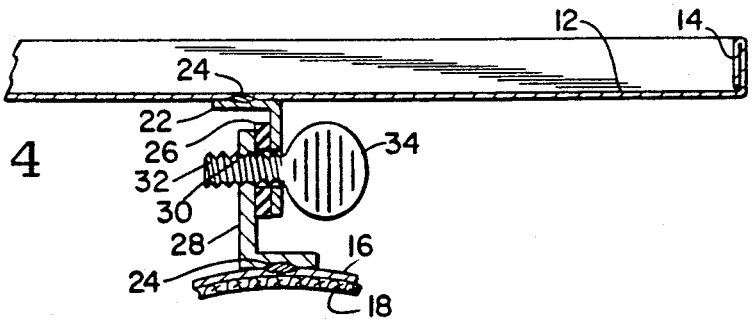
FIG. 4 is a sectional view, on an enlarged scale, taken along section line 4—4 on FIG. 3 illustrating the specific structure of the pivotal connection between the tray and the leg engaging support member.
Figure 3:
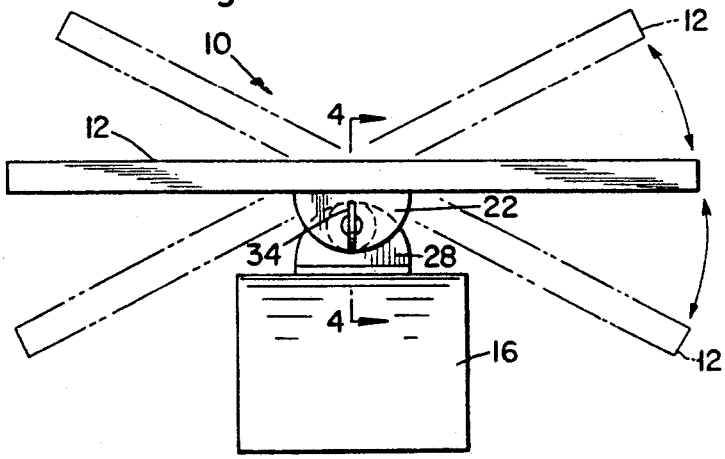
FIG. 3 is an end elevational view of the tray illustrating the adjusted positions thereof in broken lines.

The tray is provided with a depending generally semicircular flange 22 that is spot-welded at 24 to the tray 12. The leg support member 16 includes a similar flange 28 also spot-welded at 24 with a resilient washer 26 positioned between the overlapping flanges as illustrated in FIG. 4. The flange 28 includes an internally threaded bore 30 which receives a threaded shank 32 of a thumb nut or wing nut 34. This enables the tray 12 and the leg engaging support member 16 to be adjusted in angular relation to each other by loosening or tightening the thumb nut 34 with the resilient washer 26 providing a frictional lock for the flanges 22 and 28 to secure the tray in a desired angular position in relation to the leg engaging support members.

FIGS. 6 and 7 illustrate a variation of the invention in which all of the common structure uses the same reference numerals. In this embodiment of the invention, the leg engaging support member 16 include leg encircling straps 36 with one strap 38 including hook members of a hook and loop pile fastener assembly while a corresponding strap 40 includes the loop component of the hook and loop fastener. This type of adjustable connection between the overlapping straps 38 and 40 is illustrated in the right hand portion of FIG. 6 is available under the trademark "VELCRO". The straps 38 and 40 are connected to the exterior surface of the terminal ends of the semicircular support member 16 by rivets 42 or other similar fastening arrangements.

This tray structure provides relatively simple structural arrangement which is relatively inexpensive to manufacture but yet is very stable in operation and capable of being adjusted to place the articles on the tray in optimum position depending upon the desires of the user. If a book is to be read, it can be supported on the tray when the tray is in one angular position whereas the tray will be horizontally disposed when food items are placed on the tray or other items placed on the tray such as a game board where it is desired to provide a horizontal supporting surface. The leg engaging support members provide downwardly opening saddles which are effectively retained on the upper surfaces of the legs of the user with the adjustable straps being provided to positively secure the leg engaging support members to the legs to preclude any possibility of the tray becoming dislodged from the legs of the user during use.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A leg supported tray comprising a generally planar tray having an upstanding peripheral edge, a pair of downwardly facing arcuate leg engaging support members adapted to engage the upper surface of the legs of a person using the tray, means pivotally interconnecting the tray and each of said support members permitting each said support member to pivot with regard to the tray and independently of the other of said pair of support members to enable the tray to pivot about an axis generally perpendicular to the legs of a person using the tray.

2. The tray as defined in claim 1 wherein said pivotal connecting means including means to lock the tray and leg engaging support members in angularly adjusted position to enable the tray to be oriented horizontally or any desired angular relation within the limits of the pivotal connection.

3. The tray as defined in claim 2 wherein each of said leg engaging support members includes cushioning material on the inner surface thereof for engagement with the leg of the user.

4. The tray as defined in claim 3 wherein said means pivotally connecting the tray and support members includes a pair of depending flanges on said tray, each of said support members including an upwardly extending flange with the flanges on the tray and the flanges on the support members oriented in overlapping position, screw threaded means extending through said flanges to form a pivot axis and clamp the flanges together to lock the tray and support members in adjusted position.

5. The tray as defined in claim 4 together with a resilient washer between the overlapping flanges to provide a friction lock between the flanges to facilitate locking of the tray and support members in angularly adjusted position.

6. The tray as defined in claim 5 together with a flexible leg encircling strap means attached to each of said leg engaging support members.

7. The tray as defined in claim 6 wherein each of said strap means includes a pair of flexible straps having one end attached to the respective ends of said support member, said straps having interengaging hook and loop pile fasteners thereon enabling longitudinal adjustment of the strap members in relation to each other to enable the strap to encircle the legs of the user.

* * * * *